US010358812B2

(12) United States Patent
Jensen et al.

(10) Patent No.: US 10,358,812 B2
(45) Date of Patent: Jul. 23, 2019

(54) JOIST HANGER

(71) Applicant: Jenwest Enterprises LLC, Eagle Mountain, UT (US)

(72) Inventors: Mark Jensen, Eagle Mountain, UT (US); Dave Ricard, Eagle Mountain, UT (US)

(73) Assignee: Jenwest Enterprises LLC, Eagle Mountain, UT (US)

( * ) Notice: Subject to any disclaimer, the term of this patent is extended or adjusted under 35 U.S.C. 154(b) by 0 days.

(21) Appl. No.: 16/002,320

(22) Filed: Jun. 7, 2018

(65) Prior Publication Data

US 2018/0363289 A1 Dec. 20, 2018

Related U.S. Application Data

(60) Provisional application No. 62/521,065, filed on Jun. 16, 2017.

(51) Int. Cl.

| | |
|---|---|
| ***E04B 1/41*** | (2006.01) |
| ***E04B 1/26*** | (2006.01) |
| *E04B 1/38* | (2006.01) |

(52) U.S. Cl.

CPC ..... *E04B 1/40* (2013.01); *E04B 1/2612* (2013.01); *E04B 2001/405* (2013.01)

(58) Field of Classification Search

CPC ..... E04B 1/40; E04B 1/2606; E04B 1/2612; E04B 1/5818; E04B 5/12; E04B 2001/405

USPC ..... 52/289, 699, 702, 712, 715; 403/232.1

See application file for complete search history.

(56) References Cited

U.S. PATENT DOCUMENTS

| | | | | | |
|---|---|---|---|---|---|
| 1,097,934 | A * | 5/1914 | Price | F16B 7/0446 | 403/190 |
| 3,601,428 | A * | 8/1971 | Gilb | E04B 1/2608 | 248/217.3 |
| 3,633,950 | A * | 1/1972 | Gilb | E04B 1/2608 | 403/384 |
| 3,907,445 | A * | 9/1975 | Wendt | E04B 1/2612 | 403/191 |
| 3,945,741 | A * | 3/1976 | Wendt | E04B 1/5818 | 403/191 |
| 3,989,398 | A * | 11/1976 | Wendt | E04B 1/2612 | 403/230 |

(Continued)

*Primary Examiner* — Joshua J Michener
*Assistant Examiner* — James J Buckle, Jr.
(74) *Attorney, Agent, or Firm* — Workman Nydegger

(57) ABSTRACT

A joist hanger includes a joist retention member, one or more flanges disposed at a top portion of the joist retention member, and a bracket having at least one arm thereof coupled to at least one or more flanges. A system for constructing a structure having a defined fire-rating along a wall that has a top plate and at least one vertical support member can include a joist hanger and fire resistant construction material. The joist hanger can include a joist retention member, a flange coupled to the joist retention member, and a bracket coupled to the flange. The flange is selectively attached to the top plate of the wall. The bracket at least partially defines a space between the vertical support member and the joist retention member, the fire resistant construction material being disposed within the space. The bracket is selectively attached to one or more of the vertical support member or the fire resistant construction material by an attachment mechanism.

20 Claims, 9 Drawing Sheets

(56) References Cited

U.S. PATENT DOCUMENTS 4,005,942 A * 2/1977 Gilb ..... E04B 1/2612 248/903
4,330,971 A * 5/1982 Auberger ..... E06B 1/6092 403/232.1
4,353,664 A * 10/1982 Gilb ..... E04B 1/2612 403/232.1
4,422,792 A * 12/1983 Gilb ..... E04B 1/2612 403/232.1
4,480,941 A * 11/1984 Gilb ..... E04B 1/2612 248/216.1
4,841,690 A * 6/1989 Commins ..... E04B 1/2608 52/105
5,054,755 A * 10/1991 Hawkes ..... B25B 5/06 269/239
5,071,280 A * 12/1991 Turner ..... E04B 1/2612 403/232.1
5,111,632 A * 5/1992 Turner ..... E04B 1/2612 403/232.1
5,240,342 A * 8/1993 Kresa, Jr. ..... E04B 1/2612 248/300
5,555,694 A * 9/1996 Commins ..... E04B 1/2612 248/300
5,564,248 A * 10/1996 Callies ..... E04B 1/2612 403/232.1
5,603,580 A * 2/1997 Leek ..... E04B 1/2612 403/168
5,778,625 A * 7/1998 Druffel ..... F21S 8/02 174/480
5,941,044 A * 8/1999 Sera ..... E04B 1/2604 403/347
6,079,176 A * 6/2000 Westra ..... E04G 9/10 249/15
6,123,745 A * 9/2000 Hess, III ..... E02D 27/016 249/30
7,343,712 B2 * 3/2008 Shelton ..... E04G 23/0218 52/126.1
9,206,594 B1 * 12/2015 Grevious ..... F16B 5/0614
10,072,412 B2 * 9/2018 Brekke ..... B21D 47/00
2004/0244328 A1 * 12/2004 Bak ..... E04B 1/2612 52/712
2006/0191233 A1 * 8/2006 Tamlyn ..... E04B 1/2612 52/702
2007/0294979 A1 * 12/2007 Lin ..... E04B 1/2612 52/702
2008/0101855 A1 * 5/2008 Lin ..... E04B 1/2612 403/232.1
2009/0113839 A1 * 5/2009 Carr ..... E04B 1/2612 52/712
2012/0222382 A1 * 9/2012 Brekke ..... E04B 1/2612 52/702
2012/0297724 A1 * 11/2012 Pope ..... E04B 1/2604 52/702
2015/0167291 A1 * 6/2015 Bundy ..... E04B 1/2612 52/702
2015/0184370 A1 * 7/2015 Brekke ..... E04B 1/2612 52/708
2018/0038094 A1 * 2/2018 Brekke ..... B21D 53/36

* cited by examiner

JOIST HANGER

CROSS-REFERENCE TO RELATED APPLICATIONS

This application claims priority to and the benefit of U.S. Provisional Application No. 62/521,065, filed Jun. 16, 2017, and entitled Joist Hanger, the entire content of which is incorporated herein by reference.

BACKGROUND

1. Technical Field

This disclosure generally relates to building materials and hardware. More specifically, the present disclosure relates to joist hangers.

2. Related Technology

The speed and efficiency of constructing a building, in addition to its structural integrity, are often dependent upon the tools or machines available to the skilled laborer. Additionally, the proper construction materials such as specialized hardware can be advantageous during the building process. Complicating the building process, however—including the selection of building materials, tools, and machinery that can be used at a given construction site—are additional considerations such as building regulations.

An exemplary set of building regulations include fire safety regulations. Briefly, certain structures and areas within buildings are often required to meet a minimum fire rating. Stairwells and elevator shafts, for example, are often required to have a minimum fire rating of two-hours. Accordingly, when constructing walls comprising and/or adjacent to a stairwell and/or elevator shaft, special considerations must be made to meet the two-hour fire rating standard. This commonly includes hanging fire resistant or retardant building material between a combustible frame and the building interior. However, currently available building materials and hardware are ill-suited and often cause additional work to be properly installed.

Accordingly, there are a number of disadvantages with building materials and hardware that can be addressed.

BRIEF SUMMARY

Implementations of the present disclosure solve one or more of the foregoing or other problems in the art with construction materials. In particular, one or more implementations can include a joist hanger having a joist retention member, one or more flanges disposed at a top portion of the joist retention member, and a bracket having at least one side thereof coupled to at least the one or more flanges.

The present disclosure also includes systems for constructing a structure having a defined fire-rating along a wall that has a top plate and at least one vertical support member. The system can include a joist hanger and fire resistant construction material. The joist hanger can include a joist retention member, a flange coupled to the joist retention member, and a bracket having a first arm coupled to the flange and a second arm disposed opposite the joist retention member, forming a space. The flange is selectively attached to the top plate of the wall. The space at least partially defined between the second arm of the bracket and the joist retention member is configured to receive the fire resistant construction material therein. The bracket is selectively attached to one or more of the vertical support member or the fire resistant construction material by an attachment mechanism.

A method of constructing a wall having a predetermined fire rating can include attaching a flange of a joist hanger to a top plate of the wall such that a bracket of the joist hanger is proximate the wall and a space is defined between the joist retention member and a second arm of a bracket associated with the flange of the joist hanger, placing one or more fire resistant construction materials within the space, and securing the bracket to the wall.

Accordingly, joist hangers and systems and methods incorporating the same are disclosed.

This summary is provided to introduce a selection of concepts in a simplified form that are further described below in the detailed description. This summary is not intended to identify key features or essential features of the claimed subject matter, nor is it intended to be used as an indication of the scope of the claimed subject matter.

Additional features and advantages of the disclosure will be set forth in the description which follows, and in part will be obvious from the description, or may be learned by the practice of the disclosure. The features and advantages of the disclosure may be realized and obtained by means of the instruments and combinations particularly pointed out in the appended claims. These and other features of the present disclosure will become more fully apparent from the following description and appended claims, or may be learned by the practice of the disclosure as set forth hereinafter.

BRIEF DESCRIPTION OF THE DRAWINGS

In order to describe the manner in which the above recited and other advantages and features of the disclosure can be obtained, a more particular description of the disclosure briefly described above will be rendered by reference to specific embodiments thereof, which are illustrated in the appended drawings. It is appreciated that these drawings depict only typical embodiments of the disclosure and are not therefore to be considered to be limiting of its scope. The disclosure will be described and explained with additional specificity and detail through the use of the accompanying drawings in which.

DETAILED DESCRIPTION

Figure 1:
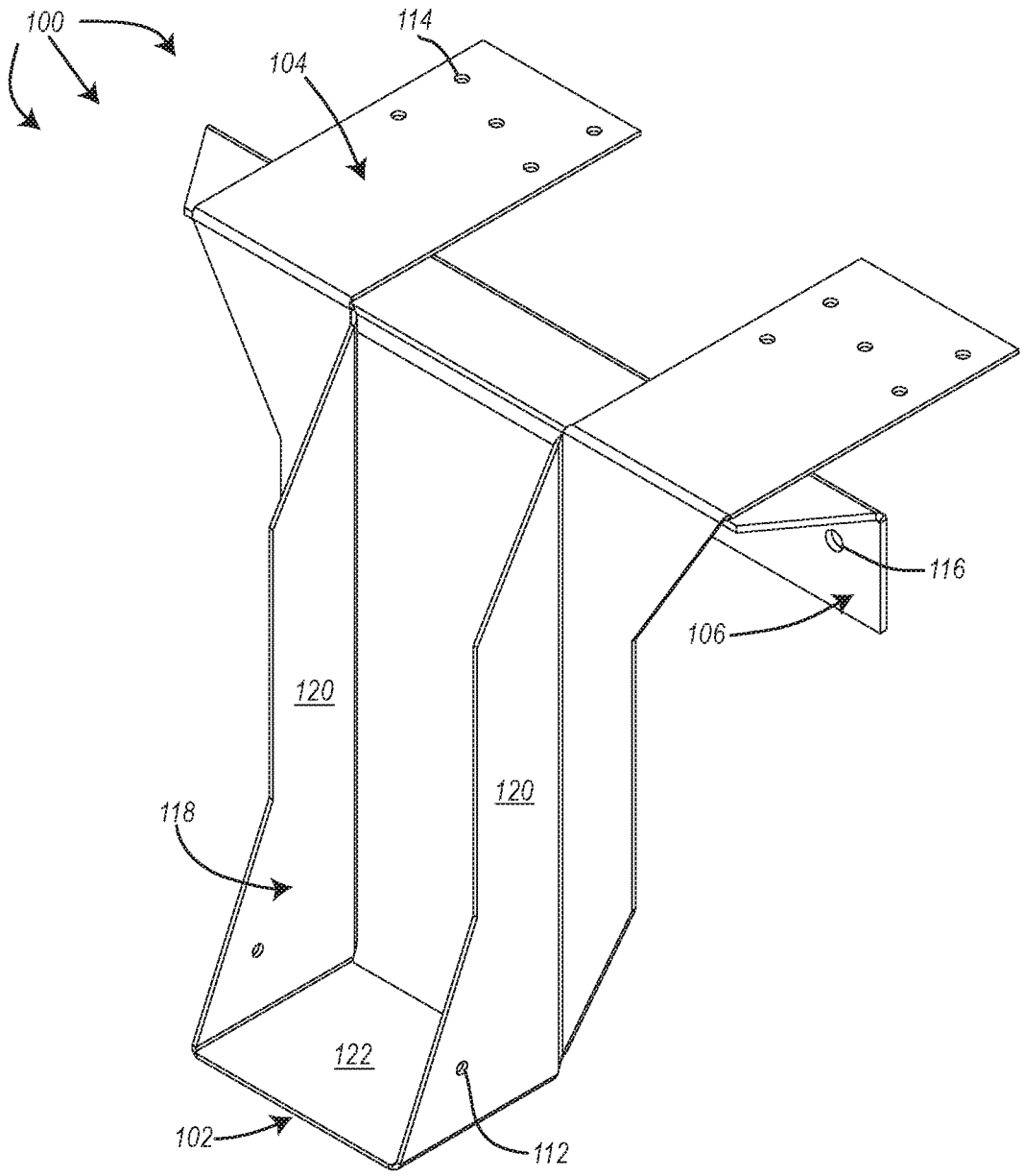
FIG. 1 illustrates a top front right perspective view of an exemplary joist hanger having an angle bracket.

Before describing various embodiments of the present disclosure in detail, it is to be understood that this disclosure is not limited to the parameters of the particularly exemplified systems, methods, apparatus, products, processes, and/or kits, which may, of course, vary. Thus, while certain embodiments of the present disclosure will be described in detail, with reference to specific configurations, parameters, components, elements, etc., the descriptions are illustrative and are not to be construed as limiting the scope of the claimed invention. In addition, the terminology used herein is for the purpose of describing the embodiments, and is not necessarily intended to limit the scope of the claimed invention.

Overview of Construction Materials and Hardware

As provided above, there are a number of factors that can affect the efficiency, structural integrity, and speed at which a building is constructed. Particularly, fire regulations can affect how a building is built in addition to the types of materials that can be used at various locations throughout the building. For example, stairwells and elevator shafts are often required to maintain at least a two-hour fire rating. This often entails placing one or more layers of fire resistant or fire retardant material between the building frame (e.g., a wooden frame) and an adjacent interior space.

Drywall is one of the most common fire resistant materials used to create a fire barrier that meets the requisite fire-rating. In many implementation, two or more panels of drywall are secured to the frame, thereby establishing the requisite fire barrier. However, when utilizing drywall (or other similar fire retardant/resistant material) to create a fire barrier, other problems arise, particularly with respect to adjoining the fire-barrier wall with other walls, joists, trusses, etc. When considering the joist-wall connection in the absence of a fire barrier, for example, a standard joist hanger can be used to help secure the joist to the top plate and/or vertical support member of the wall. The same joist-wall connection becomes complicated when there are two intervening layers of drywall. It is often the case that the skilled laborer or crew of skilled laborers responsible for framing are often a different individual or crew of skilled laborers than those responsible for hanging drywall. Thus, during construction of a wall acting as a fire barrier, the framers are initially tasked with raising a frame. At that point, the drywall crew comes and hangs the drywall on the frame to create the fire barrier. The framers are called back once more to connect the joists (and other framing components) to the fire barrier wall.

The rotations of different crews and/or skilled laborers decreases efficiency, and other alternatives are fraught with similar inefficiencies or can additionally, or alternatively, cause an inadvertent violation of the regulations related to the fire-rating. Further, there are no commercially available building materials or hardware that solve this problem.

Embodiments of the present disclosure include joist hangers that can be installed directly onto the framed wall and which are configured to leave a gap between the frame and the joist retention member that is sized and shaped to accommodate a fire retardant/resistant panel, which can, in some embodiments, include one or more panels of drywall. An exemplary joist hanger includes a joist retention member, an extended top flange disposed at a first end of the joist retention member and being orthogonal thereto, and a bracket attached to the extended top flange. The bracket is sized and shaped to accommodate the fire retardant/resistant panel and can additionally prevent the joist retention member from being positioned too close to the frame of the fire barrier, thereby preserving an appropriately sized space for fire retardant/resistant panel(s) to fit between the joist retention member and the wall frame.

Joist Hanger Having an Angle Bracket

Figure 2:
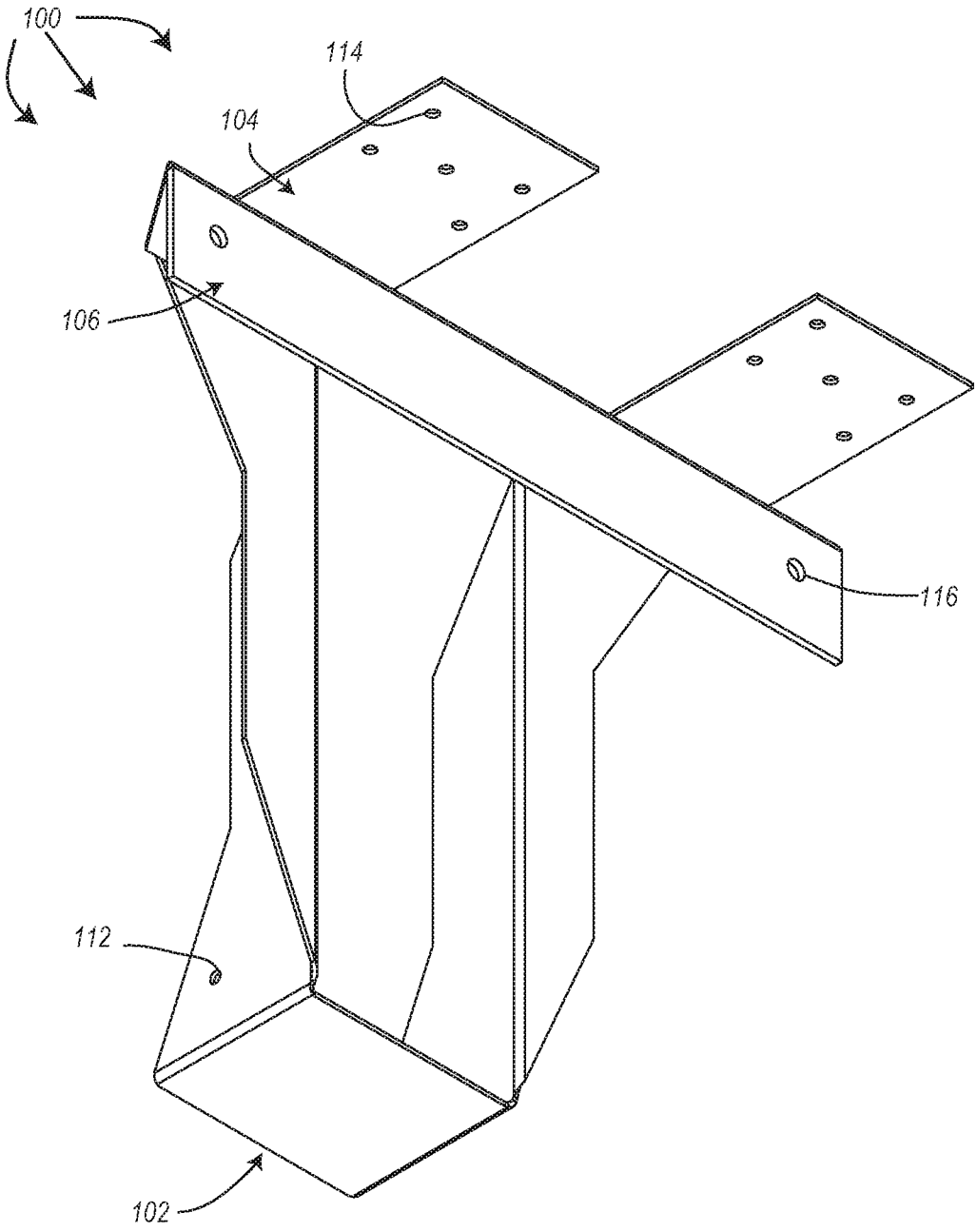
FIG. 2 illustrates a bottom rear right perspective view of the exemplary joist hanger of FIG. 1.

Referring now to the figures, FIGS. 1 and 2 illustrate an exemplary joist hanger 100. In the front top right perspective view of FIG. 1, the joist hanger 100 includes a joist retention member 102, a set of flanges 104, and an angle bracket 106. The joist retention member 102 is sized and shaped to accommodate a joist. The joist retention member 102 includes an opening 118 that is defined on two sides by vertical support members 120 and on a bottom side by joist support platform 122. When a joist is associated with the joist retention member 102, it is placed within and rests on and/or is supported by the joist support platform 122 and bounded on its sides by the vertical support members 120. The joist can be secured to the joist retention member 102 by, for example, bolting, screwing, or nailing the vertical support members 120 to the joist through joist securing aperture(s) 112. It should be appreciated that in some embodiments the joist can be coupled to or otherwise associated with the joist retention member using any attachment mechanism, as that term is understood and defined herein, and at one or more additional, or alternative, points than at a defined joist securing aperture.

As noted, the joist hanger 100 includes a pair of flanges 104. As shown in FIG. 1, the flanges 104 are disposed at a top portion of the joist retention member 102 and positioned orthogonal to the vertical support member 120. In some embodiments, the flanges are not orthogonal to the vertical support member; rather, the flanges are positioned at an angle other than 90 degrees. It should be appreciated that the angle of the flange attachment to the joist retention member can be adjusted based on circumstance or preference. Nevertheless, as illustrated in FIG. 1, the flanges 104 are orthogonal to the joist retention member 102, and this is advantageous because it allows for optimal structural support, weight transfer, and load bearing capacities when associated with a wall. For example, the flanges 104 include a plurality of flange securing apertures 114 disposed therein. In some embodiments, the flanges include at least one flange securing aperture. The flange securing apertures 114 allow the joist hanger to be secured to a wall element, such as a top plate, using a bolt, screw, nail, or other attachment mechanism. By securing the joist hanger 100 to a wall element, the joist hanger becomes anchored thereto, which increases the structural support, weight transfer, and load bearing capacities of the joist hanger. The flanges can also reduce the amount of deflection experienced by the joist hanger when mounted and in use.

In some embodiments, the flanges are elongated. This can allow, for example, the flanges to extend to a top plate, or in some embodiments, extended flanges can allow the flanges to be secured at a central portion of the wall element. As illustrated in FIG. 1, the flanges 104 are elongated to accommodate the additional space imposed by the angle bracket 106. For example, when the joist hanger 100 in a position for being secured to a wall element (e.g., adjacent to a wall element), an edge or arm of the angle bracket 106 prevents the joist retention member 102 from contacting the wall element directly. In doing so, a space is provided to accommodate, for example, fire retardant/resistant materials such as drywall. The extended flanges 104, therefore, allow the flanges an additional reach so that the flanges can be secured to a wall element (e.g., a top plate, frame element, truss, etc.) while at the same time providing a space between the wall and joist retention member for later use.

In some embodiments, the length of the angle bracket can affect the distance or space provided between the joist hanger and an associated wall element. For example, a shorter angle bracket will induce a smaller space, whereas a longer angle bracket will create a larger space. As shown in FIG. 1, a sidewall or arm of the angle bracket 106 is adjacent to, supported against, and/or coupled to the flanges with a second arm extending therefrom opposite a surface of the joist hanger. In some embodiments, the second arm is transverse (e.g., orthogonal) to the portion of the flanges that are configured to secure to a wall element.

It should be appreciated that although the angle bracket 106 is depicted in FIG. 1 as being oriented with an arm adjacent to the flange 104 and a second arm opposite from and a distance away from the joist retention member 102, the orientation of the angle bracket can, in some embodiments be mirrored such that a first arm of the angle bracket remains adjacent to the flanges but the second arm is now disposed adjacent to the joist retention member. In such a configuration, the second arm of the angle bracket and the wall define a space for receiving the fire retardant/resistant material.

The angle bracket 106 can include one or more apertures 116 disposed on a face thereof, as shown in FIG. 1. A screw, bolt, nail, or other attachment mechanism can be inserted through the aperture 116 to secure the joist hanger 100 to the wall element—and through any intervening structures placed in the space therebetween such as drywall or other fire retardant/resistant building material. In the orientation depicted in FIG. 1, having the aperture disposed in the illustrated orientation can beneficially add to the structural integrity of the joist hanger and/or the load bearing capacity thereof. The aperture can be sized and shaped to receive, for example, the shank portion of an attachment mechanism but to not permit the head of the attachment mechanism to pass therethrough.

In some embodiments, where a face of the angle bracket is opposite the wall element, an angle bracket aperture can be of any size or shape as those described above. In some embodiments, however, it may be advantageous to size and shape the aperture such that it permits the shank and the head portions of the attachment mechanism to pass therethrough. In further embodiments, the aperture can be sized and shaped to permit an attachment mechanism driving tool such as, for example, a screwdriver or powered drill bit and/or a head portion thereof to be driven therethrough.

It should be appreciated that the dimensions shown (explicitly or implicitly) in the figures are exemplary by nature. Accordingly, it is within the scope of this disclosure to include alternative dimensions. For example, as discussed above, the flanges can be elongated to a desired length. As an additional example, the joist retention member can include alternative dimensions. The vertical support members can be longer or shorter than illustrated in the figures and can be sized according to a particular implementation. Additionally, or alternatively, the joist support platform can be sized to accommodate any sized joist. For example, the joist support platform can be sized to snugly fit a single 2"×10", 2"×8", 2"×6", 2"×4", 4"×4", or other dimensioned joist on end (the joist having a desired length) or it can be sized to snugly fit a plurality of directly coupled 2"×10", 2"×8", 2"×6", 2"×4", 4"×4", or other dimensioned joist to one another (the resulting joist having a desired length).

Joist Hanger Having a U-Bracket

Figure 3:
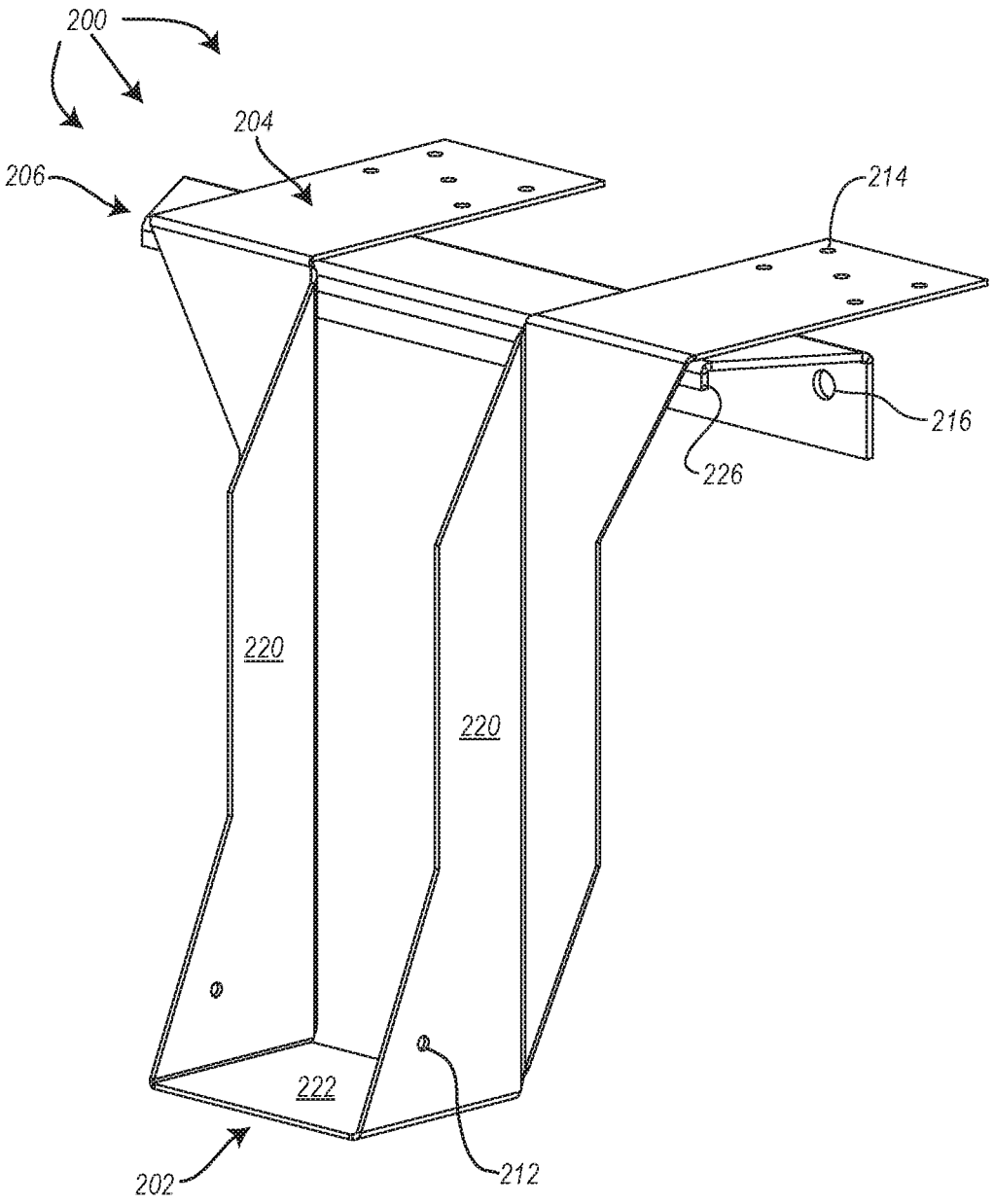
FIG. 3 illustrates a top front right perspective view of an exemplary joist hanger having a U-bracket.
Figure 4:
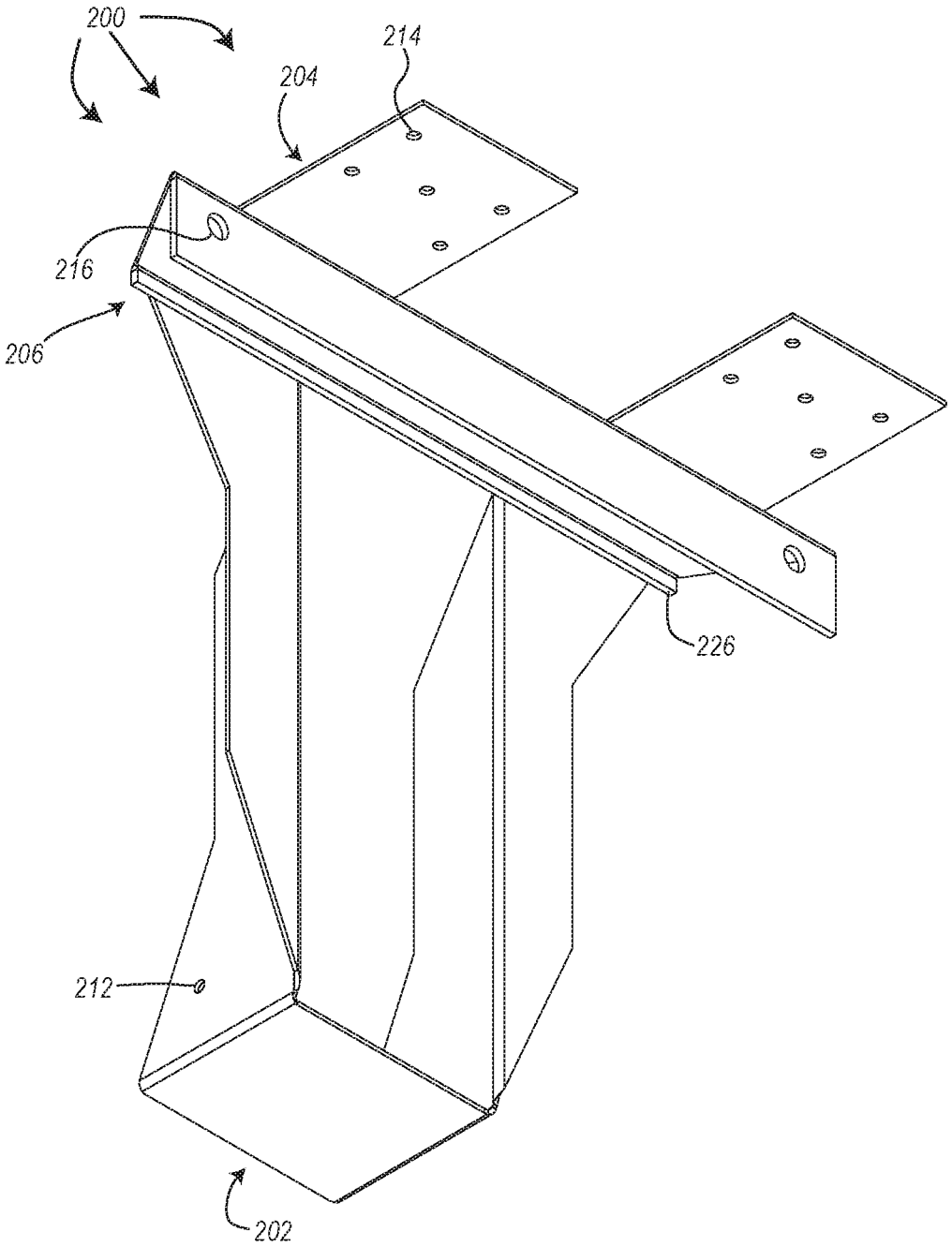
FIG. 4 illustrates a bottom rear right perspective view of the exemplary joist hanger of FIG. 3.

FIGS. 3 and 4 illustrate another exemplary joist hanger 200. The joist hanger 200 is the same or similar in many respects to the joist hanger 100 of FIGS. 1 and 2. However, instead of having an angle bracket 106, as shown in the joist hanger 100 of FIGS. 1 and 2, the joist hanger 200 of FIGS. 3 and 4 include a U-bracket 206. As perhaps better illustrated by FIG. 4, the U-bracket 206 includes an angle bracket having a lip 226 on a same side as the joist retention member 202. The lip, in combination with the remaining faces give the U-bracket its characteristic U- or J-shaped appearance.

In some embodiments, and as pictured in FIG. 4, the lip 226 extends a distance below the flanges 204. The distance is, in some embodiments, less than the distance between the flanges 204 and the aperture 216 on an opposing face of the U-bracket such that a bolt, screw, nail, or other attachment mechanism placed through the aperture 216 does not interfere with the lip 226 or the lip 226 does not interfere with a bolt, screw, nail, or other attachment mechanism being placed through the aperture. In some embodiments, the lip extends beyond such a distance and includes a corresponding aperture to allow the bolt, screw, nail, or other attachment mechanism to span the U-bracket without interference from the lip.

It should be appreciated that in some embodiments, the U-shaped bracket can act to increase the structural integrity of the joist hanger 200, as a whole. The U-shaped bracket can additionally be associated with a joist retention member and flange in a mirror image position as that shown in FIGS. 3 and 4. The mirror-image positioning of the U-bracket can provide the same or similar advantages and/or manner of securing to a wall element as that described above with respect to the alternatively positioned angle bracket.

Implementations of Exemplary Joist Hangers

Figure 5:
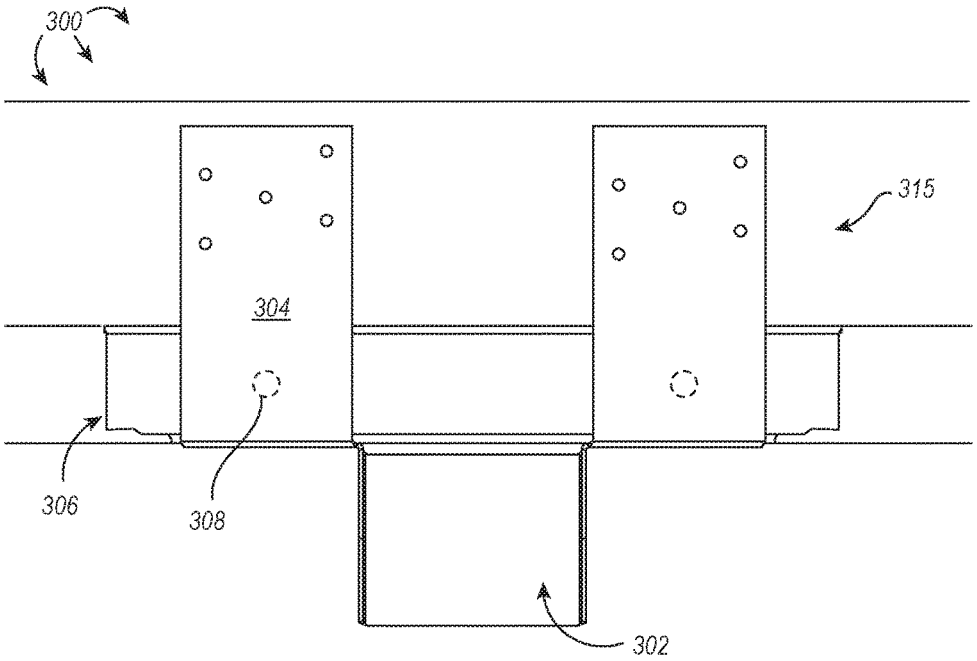
FIG. 5 illustrates a top plan view of an exemplary joist hanger having a U-bracket.
Figure 6:
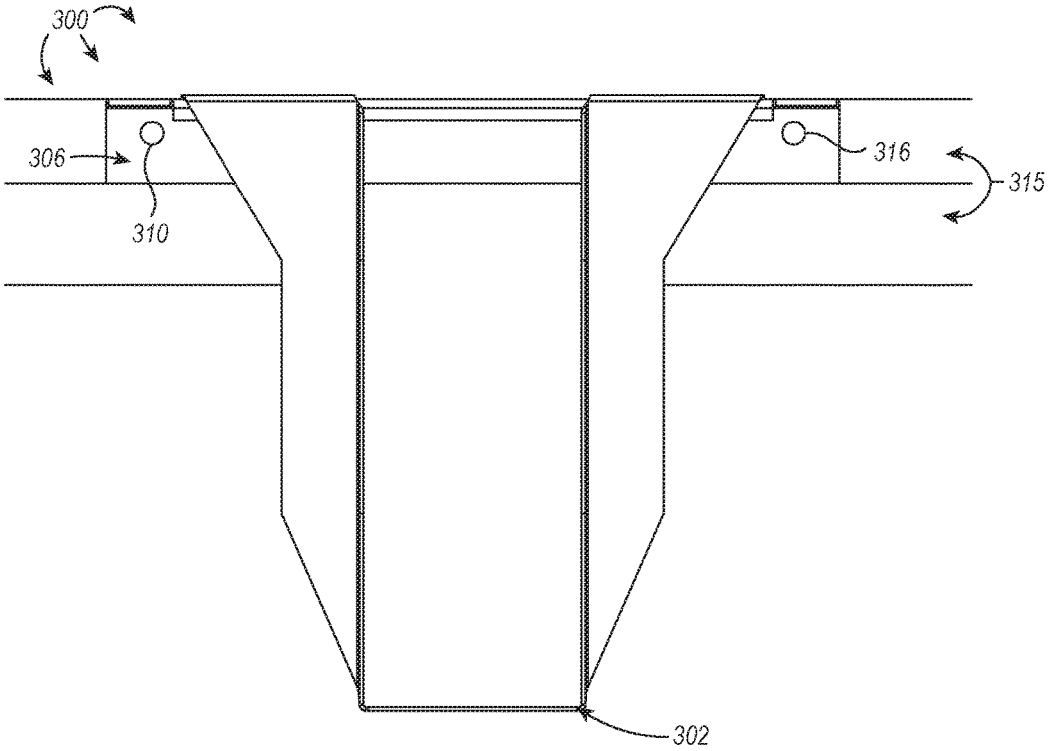
FIG. 6 illustrates a front profile view of the exemplary joist hanger of FIG. 5 partially secured to a wall element.
Figure 7:
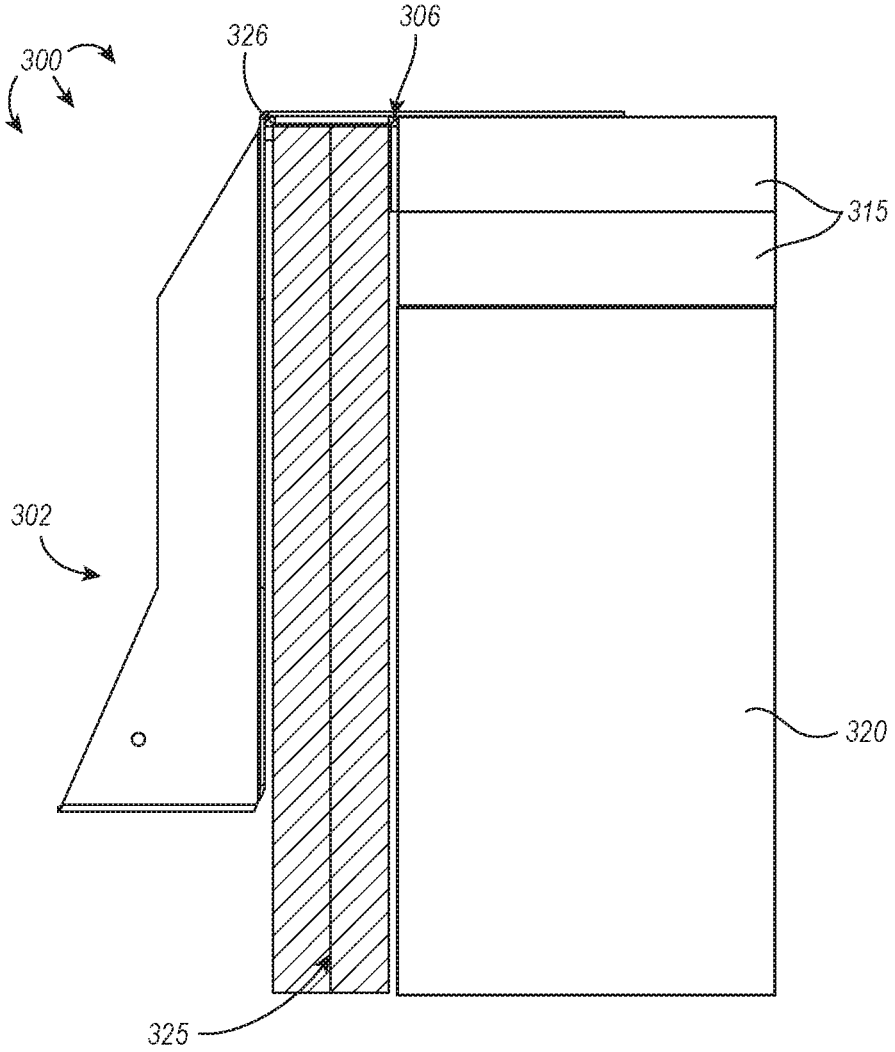
FIG. 7 illustrates a side profile view of the exemplary joist hanger of FIG. 5 with a plurality of wall elements disposed within the U-bracket of the exemplary joist hanger.

FIGS. 5-10 illustrate implementations of joist hangers as applied to one or more wall elements. For example, FIGS. 5-7 illustrate a U-bracket-based joist hanger 300 similar in many ways to the joist hanger 200 of FIGS. 3 and 4. Illustrated in FIG. 5 is a top plan view of joist hanger 300. The joist hanger 300 is shown as having the U-bracket 306 coupled to the flanges 304 at attachment site 308. The attachment site 308 can include a rivet that physically couples the flanges 304 to the U-bracket 306, or in some embodiments, the attachment site can be representative of locations where the flanges are spots welded on to the U-bracket. In some embodiments, the U-bracket is attached to the flanges using an attachment mechanism, as that term is understood and defined herein.

Referring now to FIG. 6, illustrated is a front profile view of the joist hanger 300 illustrated in FIG. 5. As shown, the apertures 316 located on the U-bracket 306 can have a screw 310 secured therethrough, attaching the joist hanger 300 two a wall element, which is illustrated in FIG. 6 as a top plate consisting of two stacked wall elements (e.g., two 2"×4"s of a desired length). In some embodiments, the screw 310 can be replaced by any other attachment mechanism suitable for this purpose and as described above.

FIG. 7 illustrates a side profile view of the joist hanger 300 illustrated in FIG. 6. As shown, the U-bracket 306 can be associated directly with a wall element, such as top plate 315, with a space between the joist retention member 302 and one or more wall elements, such as top plate 315 and/or vertical support member 320. The space is used to accommodate two panels of drywall 325 with the joist retention member 302 being brought into close proximity to (or touching) the drywall 325. It should be appreciated, as discussed above, that the drywall 325 of FIG. 7 can be replaced by one or more fire retardant/resistant materials or other desirable construction materials.

Figure 8:
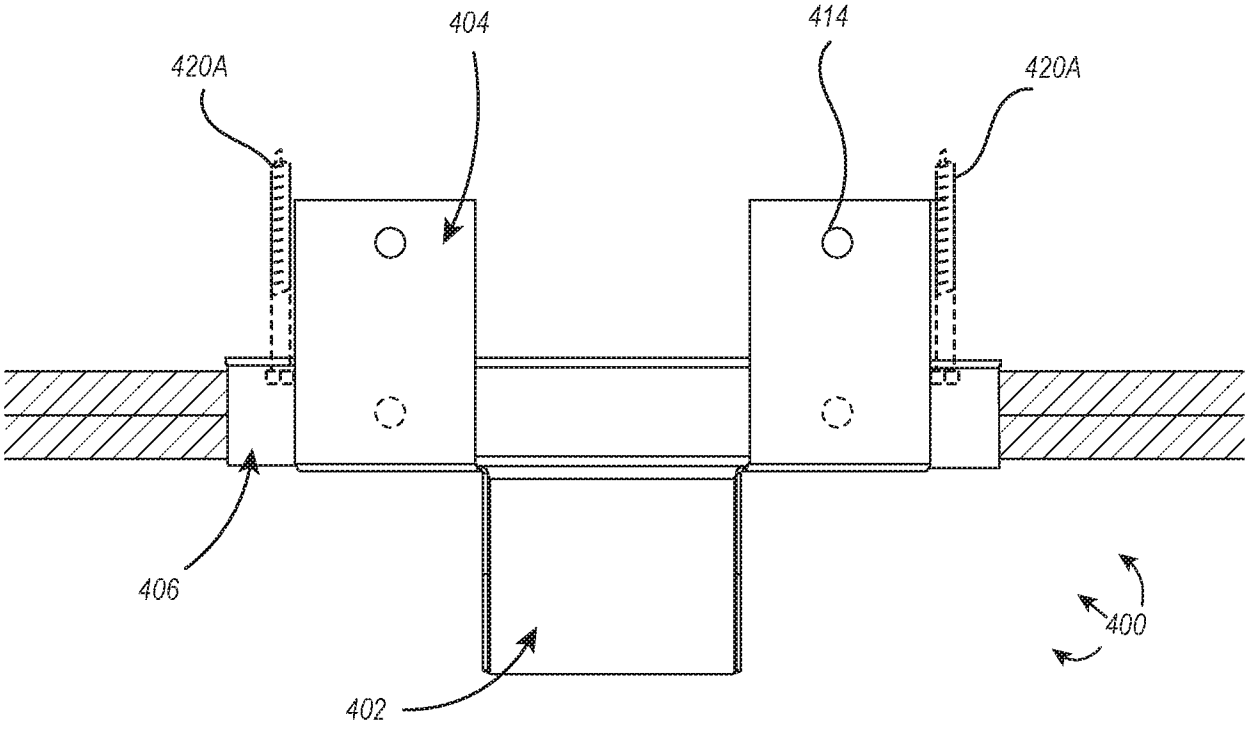
FIG. 8 illustrates a top plan view of an exemplary joist hanger having an angle bracket and which is partially secured to a wall element.
Figure 9:
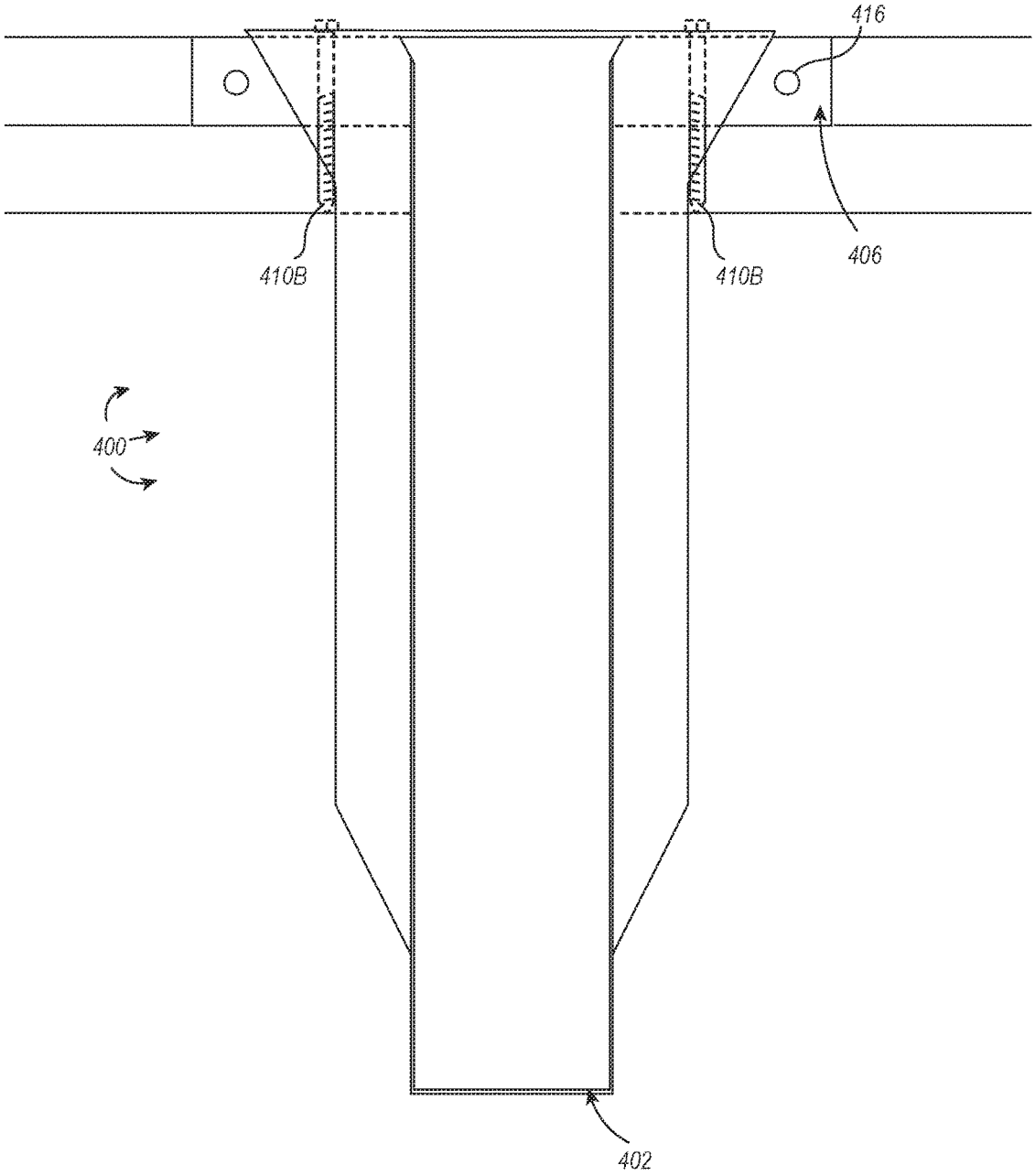
FIG. 9 illustrates a front profile view of the exemplary joist hanger of FIG. 8 partially secured to a wall element.
Figure 10:
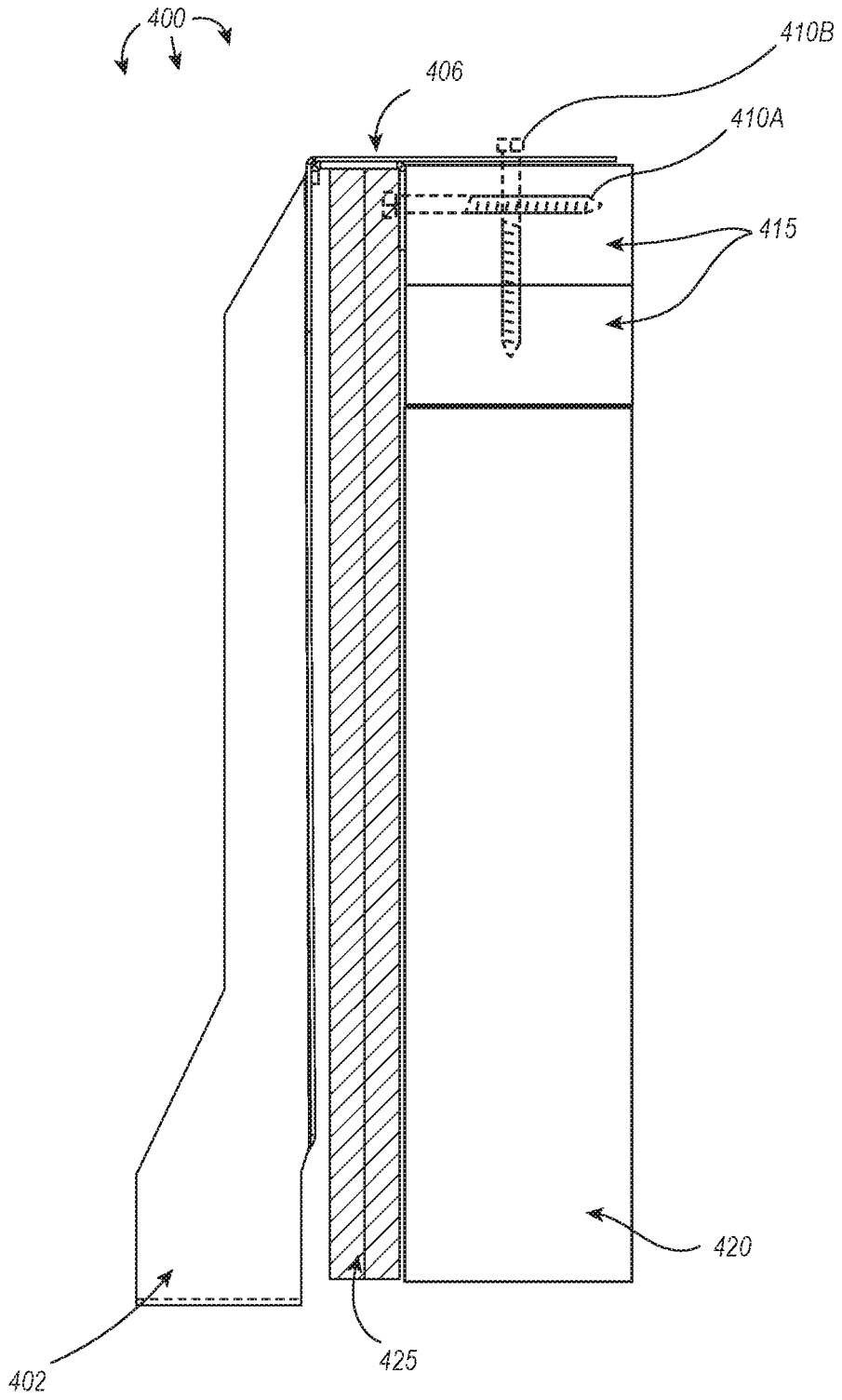
FIG. 10 illustrates a side profile view of the exemplary joist hanger of FIGS. 8 and 9 that is secured to a plurality of wall elements.

Referring now to FIGS. 8-10, illustrated is an angle-bracket-based joist hanger 400 similar in many ways to the joist hanger 100 of FIGS. 1 and 2. As illustrated in FIGS. 8-10 the joist hanger 400 has two screws 410A positioned through apertures 416 and into top plate 415 (as shown, for example, in FIGS. 8 and 10), thereby securing the joist hanger 400 to a front side of the top plate 415. Additionally, the joist hanger 400 has two screws 410B positioned through apertures 414 on flanges 404 (as shown, for example, in FIGS. 9 and 10), thereby securing the joist hanger to a top side of the top plate 415. As illustrated in FIG. 10, the screws 410B penetrate both wall elements comprising the top plate 415.

With specific reference to FIG. 10, illustrated is a side profile view of the joist hanger 400. As shown, the angle bracket 406 is associated directly with the top plate 415, leaving a space between the joist retention member 402 and the one or more wall elements, such as top plate 415 and/or vertical support member 420. The space is used to accommodate two panels of drywall 425 with the joist retention member 402 being brought into close proximity to (or touching) the drywall 425. It should be appreciated, as discussed above, that the drywall 425 of FIGS. 8 and 10 can be replaced by one or more fire retardant/resistant materials or other desirable construction materials.

In one or more implementations of the present disclosure, a joist holder can be attached to wall elements, leaving a space for the drywall or other fire retardant/resistant building material (or other building material) to be placed therein. This allows, in some embodiments, for a more efficient construction of fire barriers. For example, a joist hanger, as described herein, can be attached to a wall element, and due to the structural configuration of the disclosed joist hanger, a space is left for and/or dedicated to fire retardant/resistant construction material or other construction material to be added at a later time or more easily thereafter. In some implementations, the joist hanger is secured to a wall element at one or more of the front and/or top face thereof followed by the addition of fire retardant/resistant construction materials (or other construction materials) in the space left between the joist retention member and wall element. In some implementations, the joist hanger can be secured to a wall element, such as a top plate followed by the addition of fire retardant/resistant construction materials (or other construction materials) in the space left between the joist retention member and wall element. The fire retardant/resistant construction materials (or other construction materials) placed in the space can then be secured to the wall element via an attachment mechanism spanning the bracket and space housing the construction materials.

Abbreviated List of Defined Terms

Unless defined otherwise, all technical and scientific terms used herein have the same meaning as commonly understood by one of ordinary skill in the art to which the present disclosure pertains. To assist in understanding the scope and content of the foregoing and forthcoming written description and appended claims, a select few terms are defined directly below.

As used herein, the term "attachment mechanism" includes any device in one or more pieces that may be used to "attach" two or more components or to "attach" one component to another component. The term "attach" and/or "attachment" may refer to its common dictionary definition where appropriate, but it may contextually refer to particular acts of connecting, associating, affixing, fastening, sticking, joining, or any combination of the foregoing that cause an object to be fixedly or selectively proximate another object. In some embodiments, the attachment mechanism may be an integral part of a component, whereas in other embodiments, the attachment mechanism may be separate.

An attachment mechanism is to be understood to have any number of movable and/or fixed parts, any of which may be singularly or in combination with one or more components interact to facilitate attachment. As non-limiting examples, an attachment mechanism may include a mechanism for attaching components using one or more—or a combination of—chemical adhesives (e.g., an epoxy and/or other thermosetting adhesives, glue, cement, paste, tape and/or other pressure-sensitive adhesives, etc.), mechanical fasteners (e.g., threaded fasteners such as a combination of a threaded rod together with a complementary threaded nut, rivets, screw, clamp, buckle, tenon and mortise pairs, cable ties, rubber bands, etc.), magnets, vacuums (e.g., suction cups, etc.), and/or interference fittings (e.g., press fittings, friction fittings, etc.). Additionally or alternatively, an attachment mechanism may include any material or element resulting from physically attaching two or more components by crimping, welding, and/or soldering.

The term "drywall," as used herein, is intended to include wall elements or panels that are constructed and/or made from one or more of plaster, gypsum (i.e., calcium sulfate dihydrate), wood pulp, or other materials and which may include a facer and backer comprised of paper or similar material. When implemented as a building material, drywall is typically used to form the interior walls of a building or other structure. It should be appreciated that the term "drywall" is intended to encompass similar and/or synonymous building materials, such as "plasterboard," "wallboard," "gypsum panel," "sheet rock," and/or "gypsum board."

Various aspects of the present disclosure, including devices, systems, and methods may be illustrated with reference to one or more embodiments or implementations, which are exemplary in nature. As used herein, the term "exemplary" means "serving as an example, instance, or illustration," and should not necessarily be construed as preferred or advantageous over other embodiments disclosed herein.

As used herein, directional terms, such as "top," "bottom," "left," "right," "up," "down," "upper," "lower," "proximal," "distal" and the like are used herein solely to indicate relative directions and are not otherwise intended to limit the scope of the disclosure and/or claimed invention.

CONCLUSION

Any headings used herein are for organizational purposes only and are not meant to be used to limit the scope of the description or the claims.

To facilitate understanding, like reference numerals (i.e., like numbering of components and/or elements) have been used, where possible, to designate like elements common to the figures. Specifically, in the exemplary embodiments illustrated in the figures, like structures, or structures with like functions, will be provided with similar reference designations, where possible.

The present disclosure may be embodied in other specific forms without departing from its spirit or essential characteristics. The described embodiments are to be considered in all respects only as illustrative and not restrictive. The scope of the invention is, therefore, indicated by the appended claims rather than by the foregoing description. While certain embodiments and details have been included herein and in the attached disclosure for purposes of illustrating embodiments of the present disclosure, it will be apparent to those skilled in the art that various changes in the methods, products, devices, and apparatus disclosed herein may be made without departing from the scope of the disclosure or of the invention, which is defined in the appended claims. All changes which come within the meaning and range of equivalency of the claims are to be embraced within their scope.

What is claimed is:

1. A joist hanger, comprising:

a joist retention member;

a first flange and a second flange disposed at a top portion of the joist retention member, the first and second flanges being configured for connection to a top of a wall; and a bracket extending between the first and second flanges, the bracket having at least one arm thereof coupled to first and second flanges, the first and second flanges extending beyond the bracket opposite the joist retention member such that the bracket is configured to space the joist retention member a predetermined distance away from a vertical face of the wall on which the joist hanger is mounted, the predetermined distance being large enough to accept one or more fire retardant or fire resistant construction materials between the joist retention member and the vertical face of the wall.

2. The joist hanger as in claim 1, wherein the one or more fire retardant or fire resistant construction materials comprise drywall.

3. The joist hanger as in claim 2, wherein the space is sized and shaped to accept two panels of drywall.

4. The joist hanger as in claim 1, wherein the joist retention member further comprises a joist support platform and a first vertical support member connected to a first side of the joist support platform.

5. The joist hanger as in claim 4, wherein the joist retention member further comprises a second vertical support member connected to a second side of the joist support platform, the second side being opposite the first side, and the second vertical support member being parallel to the first vertical support member and orthogonal to the joist support platform.

6. The joist hanger as in claim 5, the first flange being disposed orthogonal to and directed away from the first retention member, and the second flange being disposed orthogonal to and directed away from the second retention member.

7. The joist hanger as in claim 1, wherein the bracket comprises an angle bracket, wherein the at least one arm comprises a first arm coupled to the first and second flanges, and wherein a second arm of the angle bracket is parallel to a vertical support member of the joist retention member, the first arm comprising an aperture.

8. The joist hanger as in claim 7, wherein the first arm of the angle bracket extends between the second arm of the angle bracket and the vertical support member of the joist retention member such that the vertical support member and the second arm are spaced apart by the predetermined distance.

9. The joist hanger as in claim 7, wherein the first arm of the angle bracket includes a first end and a second end, the first end being connected to the second arm, and the second end being connected to a lip disposed opposite and parallel to the second arm.

10. The joist hanger as in claim 9, wherein a space is defined between the lip and the second arm, the space configured to accept one or more fire retardant or fire resistant construction materials.

11. A system for constructing a structure having a defined fire-rating along at least one wall having a top plate and at least one vertical support member, the system comprising:

a joist hanger, the joist hanger comprising:

a joist retention member;

a flange having a first end and a second end, the first end of the flange being coupled to the joist retention member, the second end of the flange being selectively attachable to the top plate of the at least one wall; and a bracket coupled adjacent to the first end of the flange, the bracket extending from the first end of the flange only partially towards the second end of the flange, such that the second end of the flange extends beyond the bracket opposite to the joist retention member, the bracket at least partially defining a space between the vertical support member and the joist retention member when the joist hanger is attached to the wall; and a fire resistant construction material disposable within the space, wherein the bracket is selectively attachable to one or more of the vertical support member or the fire resistant construction material by an attachment mechanism.

12. The system as in claim 11, wherein the fire resistant construction material comprises one or more drywall panels.

13. The system as in claim 11, wherein the bracket comprises an angle bracket or a U-shaped bracket.

14. The system as in claim 13, wherein the bracket comprises a plurality of apertures configured to permit at least a portion of the attachment mechanism therethrough.

15. The system as in claim 11, wherein the joist retention member further comprises a joist support platform and a first vertical support member connected to a first side of the joist support platform.

16. The system as in claim 15, wherein the joist retention member further comprises a second vertical support member connected to a second side of the joist support platform, the second side being opposite the first side, and the second vertical support member being parallel to the first vertical support member and orthogonal to the joist support platform.

17. The system as in claim 16, wherein an opening is defined by the first vertical support member, the second vertical support member, and the joist support platform, the opening being sized and shaped to receive a joist.

18. A method of constructing a wall having a predetermined fire rating using the joist hanger of claim 1, the method comprising:

attaching the first and second flanges of the joist hanger to a top plate of the wall such that the bracket of the joist hanger is proximate the wall and the space is defined between the wall and the joist retention member of the joist hanger;

placing one or more fire resistant construction materials within the space; and securing the bracket to the wall.

19. The method as in claim 18, wherein placing the one or more fire resistant construction materials within the space comprises substantially filling the space with the one or more fire resistant construction materials.

20. The method as in claim 18, wherein securing the bracket to the wall comprises disposing at least a portion of an attachment mechanism through an aperture in the bracket and into at least a portion of the wall.

* * * * *